US007325769B1

(12) United States Patent
Harnisch et al.

(10) Patent No.: US 7,325,769 B1
(45) Date of Patent: Feb. 5, 2008

(54) FAST-PIVOT MISSILE FLIGHT CONTROL SURFACE

(75) Inventors: Paul E. Harnisch, Phoenix, AZ (US); Robert E. Winkel, Phoenix, AZ (US)

(73) Assignee: Honeywell International, Inc., Morristown, NJ (US)

( * ) Notice: Subject to any disclaimer, the term of this patent is extended or adjusted under 35 U.S.C. 154(b) by 408 days.

(21) Appl. No.: 11/067,038

(22) Filed: Feb. 25, 2005

(51) Int. Cl.
*F42B 10/64* (2006.01)

(52) U.S. Cl. ..... 244/3.28; 244/3.27

(58) Field of Classification Search ..... 244/3.27, 244/3.28, 3.24, 3.29
See application file for complete search history.

(56) References Cited

U.S. PATENT DOCUMENTS 7,147,181 B2 * 12/2006 Selin et al. ..... 244/3.27

* cited by examiner

*Primary Examiner*—Timothy D. Collins
(74) *Attorney, Agent, or Firm*—Ingrassia, Fisher & Lorenz

(57) ABSTRACT

Methods and apparatus are provided for a missile that includes a housing, a fin, and a first actuator. The housing has a slot formed therethrough. The fin is disposed within the housing proximate the slot. The first actuator is coupled to the fin and configured to selectively move the fin at least partially in and out of the housing through the slot.

13 Claims, 6 Drawing Sheets

FAST-PIVOT MISSILE FLIGHT CONTROL SURFACE

FIELD OF THE INVENTION

The present invention generally relates to missiles, and more particularly relates to missile flight controls.

BACKGROUND OF THE INVENTION

Different types of missiles and other projectiles have been produced in response to varying defense needs. Some missiles are designed for tactical uses, while others are designed for strategic uses. In either case, each type of missile is equipped with a path control system that guides the missile to its target. In most configurations, the path control system may include a controller coupled to aerodynamic flight control surfaces. The flight control surfaces are fixed onto a shaft that extends through the missile. In some configurations, the flight control surfaces extend out of the missile either along the body of the missile or in some configurations, proximate thrust vectoring vanes or thrusters near the missile's exhaust outlet. Typically, the controller has flight instructions programmed therein, or is configured to receive wireless signals that guide the missile on a flight path.

During missile flight, the path control system components operate together to maintain the missile on its intended path by adjusting its pitch, yaw, or roll. The missile is thrust forward in a first direction either as a projectile from a launch apparatus or under sustained thrust using a self-contained rocket or jet engine. When the missile flight direction needs to be altered the controller instructs the shaft to rotate to thereby pivot the flight control surfaces in the missile's airstream and to provide a force that alters that missile's flight path. Consequently, the missile travels in a second direction.

Although the above-mentioned path control system is effective, it may suffer from certain drawbacks. For example, as briefly mentioned above, the aerodynamic flight control surfaces utilized in typical missile applications are affixed to the missile and are always extended outside of the missile body. As a result, the flight control surfaces may produce aerodynamic drag even when traveling in a straight line. Consequently, a top speed and range of travel may be limited.

Accordingly, it is desirable to have a missile that has a reduced aerodynamic drag and includes a simply-designed path control system that is inexpensive to manufacture. In addition, it is desirable for the path control system to be relatively lightweight. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A missile is provided that includes a housing, a fin, and a first actuator. The housing has a slot formed therethrough. The fin is disposed within the housing proximate the slot. The first actuator is coupled to the fin and configured to selectively move the fin at least partially in and out of the housing through the slot.

In another exemplary embodiment, a missile is provided having a tube, a first fin, a first actuator, and an energy supply. The tube has a first slot formed therethrough. The first fin is disposed within the tube. The first actuator is coupled to the first fin and includes a first arm, a second arm, and a first and a second latch mechanism, a stop element, and an energy supply. The first arm is coupled to an axis. The second arm is coupled to the axis and the fin and is configured to selectively rotate relative to the first arm between first and second predetermined positions. The first and second latch mechanisms mounted to the second arm at first and second mounting positions, respectively, wherein the first mounting position positions the fin out of the tube and the second mounting position positions the fin inside of the tube. The stop element is coupled to the first arm and is positioned between and capable of contacting the first and second latch mechanisms. The energy supply is coupled to the first and second arms and configured to provide kinetic energy to the one of the first and second arms to cause the arm to rotate and cause the stop element to selectively contact the first latch mechanism and the second latch mechanism and to selectively move from inside the tube, through the first slot, at least partially outside of the tube when the first arm rotates relative to the second arm between the first and second predetermined positions.

A method is provided for changing a direction of travel of a missile, the missile having a housing having a slot formed therethrough, a fin disposed within the housing proximate the slot; and a first actuator coupled to the fin and configured to selectively move the fin at least partially in and out of the housing through the slot, the first actuator comprising a rotating arm coupled to an axis and configured to selectively rotate between first and second predetermined positions, a second arm coupled to the axis, a stop element and an electromagnetic core coupled to the rotating arm, an electromagnetic coil coupled to the second arm, and first and second latch mechanisms mounted to the second arm at first and second mounting positions, respectively, positioned and configured to contact the stop element. The method includes the steps of pulsing energy to the electromagnetic coil to produce a magnetic field in a first direction, attracting the electromagnetic core toward the first direction to thereby rotate the rotating arm in the first direction and cause the fin to move at least partially outside of the housing, and latching the stop element to the first latch mechanism to stop rotation of the rotating arm.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Although the invention is described herein as being implemented in a missile, the invention may be employed on any one of numerous other projectiles capable of flight through air, space, and/or water, from one point to another. Furthermore, there is no intention to be bound by any theory presented in the preceding background of the invention or the following detailed description of the invention.

Figure 1:
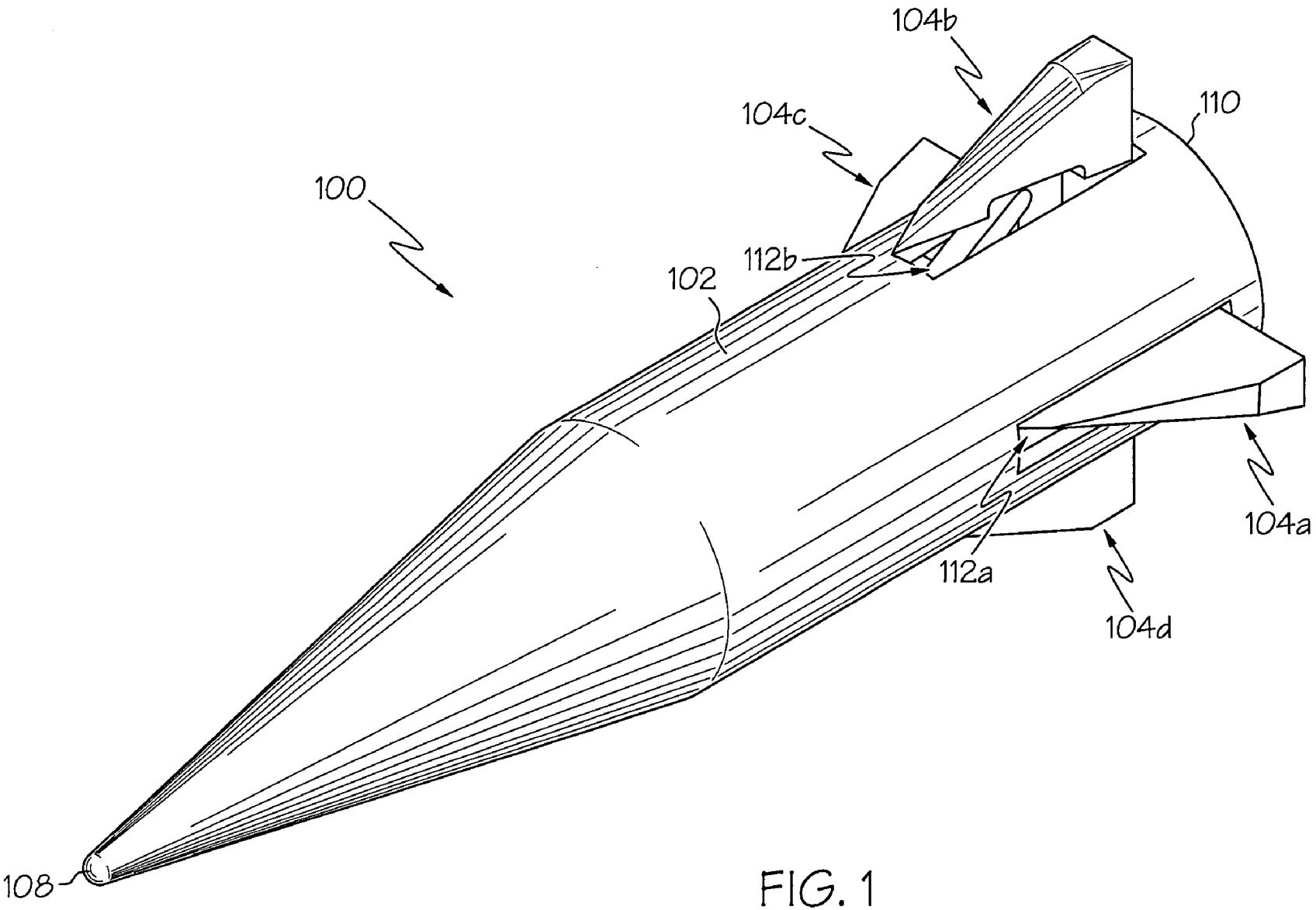
FIG. 1 is an isometric view of an exemplary missile fully deployed.

Turning now to FIG. 1, an exemplary missile 100 is illustrated. The missile 100 includes at least a housing 102, non-illustrated fuel, and fin assemblies 104*a*, 104*b*. It will be appreciated that the missile 100 may also include other components that may be needed to complete a flight or mission, for example, explosive components, an on-board computer components, or communication hardware. The housing 102 is configured to contain at least the fuel and the fin assemblies 104*a*, 104*b* and may have any one of numerous appropriate shapes, for example, pencil-shaped in FIG. 1, or tube-shaped. The housing 102 includes a nose end 108, a thruster end 110, and a plurality of slots 112*a*, 112*b*. The nose end 108 is located at a front section of the housing 102 and may have any one of numerous aerodynamic shapes, for example, rounded or pointed. The nose end 108 may be integrally formed on the housing 102 or may be separately formed and subsequently coupled to the housing 102. The thruster end 110 is disposed at an aft section of the housing 102 and is configured to provide an outlet for byproduct gases produced when the non-illustrated fuel is ignited and exhausted during a craft flight sequence.

The plurality of slots 112*a*, 112*b* is formed in the housing 102 between the nose end 108 and thruster end 110 and each slot 112*a*, 112*b* is configured to provide an opening through which at least one component of the fin assembly 104 moves into and out of. Although each slot 112*a*, 112*b* is depicted in FIG. 1 as being disposed proximate the thruster end 110 of the housing 102, and substantially equidistant from one another, it will be appreciated that the plurality of slots 112*a*, 112*b* may be formed in any other suitable section of the housing 102. For example, the slots 112*a*, 112*b* may be formed proximate the nose end 108 of the housing 102 or substantially in between the nose end 108 and thruster end 110. Additionally, the slots 112*a*, 112*b* may be formed in any aerodynamically suitable pattern along an outer surface of the housing 102, such as, for example as shown in FIG. 1, in a circular pattern, in a staggered pattern around the circle, or in a linear pattern. Moreover, although two slots 112*a*, 112*b* are specifically shown, two other slots are understood to be included to provide openings for the four illustrated fin assemblies 104*a*, 104*b*, 104*c*, 104*d*. It will also be understood that more or fewer slots 112*a*, 112*b* than illustrated may be employed. The particular placement and number of slots 112*a*, 112*b*, however, depends on the configuration and directional capabilities of the fin assemblies 104*a*, 104*b*.

Figure 2:
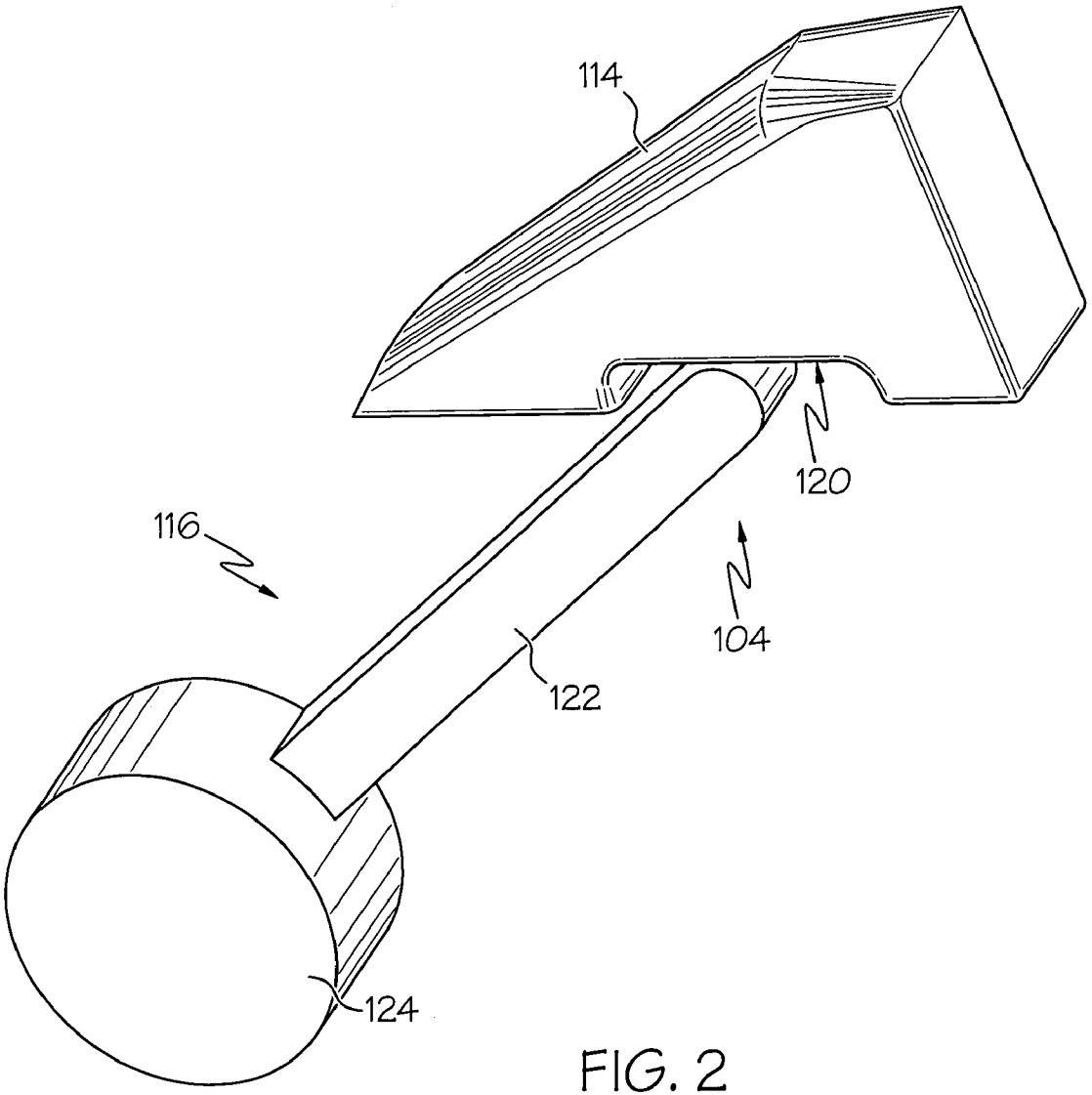
FIG. 2 is a close up view of an exemplary fin and actuator that may be implemented in the exemplary missile illustrated in FIG. 1.

As briefly alluded to above, each of the fin assemblies 104*a*, 104*b* is disposed within the housing 102 proximate a corresponding slot 112*a*, 112*b*. The fin assemblies 104*a*, 104*b* are preferably positioned such that at least a portion of the assembly 104 is capable of extending through its corresponding slot 112*a*, 112*b* outside of the housing 102. With reference now to FIG. 2, a close up view of an exemplary fin assembly 104 is provided. The fin assembly 104 includes a fin 114 and an actuator 116. The fin 114 is configured to direct the missile 100 to travel in a certain direction when deployed during missile flight and may have any one of numerous other suitable configurations. For example, the fin 114 may be triangular, as depicted in FIGS. 1 and 2. Additionally, the fin 114 is preferably constructed of an inexpensive, light-weight material capable of substantially maintaining its shape when subjected to high wind speeds. No matter the particular configuration, the fin 114 includes a coupling surface 120 formed therein that is configured to couple the fin 114 to the actuator 116. The coupling surface 120 has any one of numerous suitable configurations. For example, as shown in FIG. 1, the coupling surface 120 is a cavity that receives the actuator 116. In another exemplary embodiment, the coupling surface 120 is a slot formed at least partially through the fin 114 for receiving the actuator 116. In another exemplary embodiment, the coupling surface 120 is a flat surface.

The actuator 116 is configured to selectively move the fin 114 between predetermined positions. For example, the fin 114 may be moved between a first position within the housing 102 to a second position outside of the housing 102. Alternatively, the fin 114 may be moved may be moved between a first position out of the housing 102 to a second position in the housing 102.

The actuator 116 includes an arm assembly 122 and a driver 124. The arm assembly 122 is coupled to the driver 124 and may be either in contact with or coupled to the coupling surface 120. The driver 124 is set to two predetermined positions and actuates the arm assembly 122 to thereby cause the fin 114 to move between the predetermined positions. Preferably, the driver 124 is a fast pivot mechanism that causes the arm assembly 122 to move rapidly.

Figure 3:
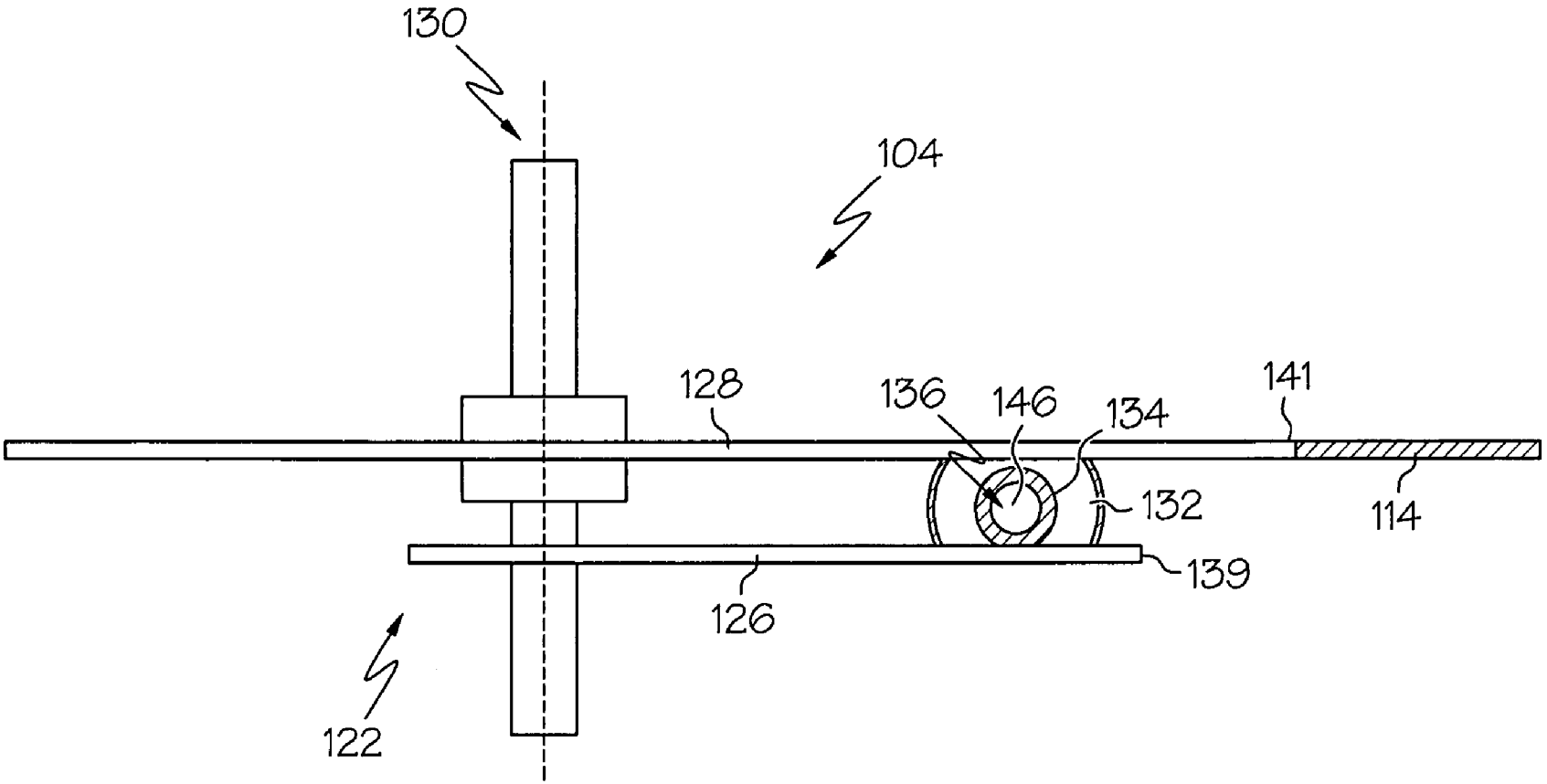
FIG. 3 is a side view of an exemplary actuator that may be implemented in the exemplary missile illustrated in FIG. 1.

Both the arm assembly 122 and driver 124 may have any one of numerous suitable configurations. For example, such as illustrated in FIG. 3, the arm assembly 122 includes a first arm 126, a second arm 128, and an axis 130, while the driver 124 includes a latch assembly 132, a stop element 134, and at least one solenoid 136. The latch assembly 132, the stop element 134, and the solenoid 136 are coupled to the one of the arms 126, 128 at its end (e.g. an end 141 of the second arm 128), while the fin 114 is coupled to or in contact with the other arm 126, 128 at its end (e.g. an end 139 of the first arm 126).

The arms 126, 128 cooperate with one another to move the fin 114 between the various predetermined positions. In this regard, each arm 126, 128 is mounted to the axis 130, and at least one of the arms 126, 128 is configured to rotate relative to the other arm 126, 128. In an exemplary embodiment, the first and second arms 126, 128 are configured such that one arm is stationary and the other arm is capable of rotational movement at least between the first and second positions. In another exemplary embodiment, both arms 126, 128 are capable of rotational movement.

In any case, the rotating arm is rotationally coupled to the axis via any one of numerous suitable devices, such as, for example, flex pivots, bearings, and flexural elements. Additionally, the rotating arm is preferably constructed with sufficient rigidity to effectively control the position of elements that may be mounted thereon and to minimize the vibration those elements may experience during or after rotation of the rotating arm. Any suitable material or device may be used to construct or to comprise the rotating arm. The stationary arm is configured to provide sufficient support to maintain a stationary position of elements that may be coupled thereto.

The axis 130 is configured to provide positioning for both the first and second arms 126, 128 and, additionally, to provide kinetic energy to rotate the rotating arm between the various predetermined positions. In this regard, the axis 130 includes a support section and one or more suitable rotational devices. The rotational device may comprise a spring that, when supplied with additional energy, can store the energy for future use or immediately transfer the energy to rotate the rotating arm. Suitable rotational devices that have springs, include but are not limited to, a torsion bar, torsion spring, or spring assembly.

In one exemplary embodiment, the rotational device provides a force to rotate the rotating arm toward the first position or second position. The rotational device of the axis 130 may be further configured to bias the rotating arm toward the first position disposed within the housing 102. The rotational device may be even further configured such that when a force is provided to rotate the rotating arm toward the second position, the rotational device provides an opposing force that pulls the rotating arm back to the first position. In yet another embodiment, the rotational device is configured to provide kinetic energy to cause the rotating arm to rotate back and forth in a harmonic motion.

Figure 4:
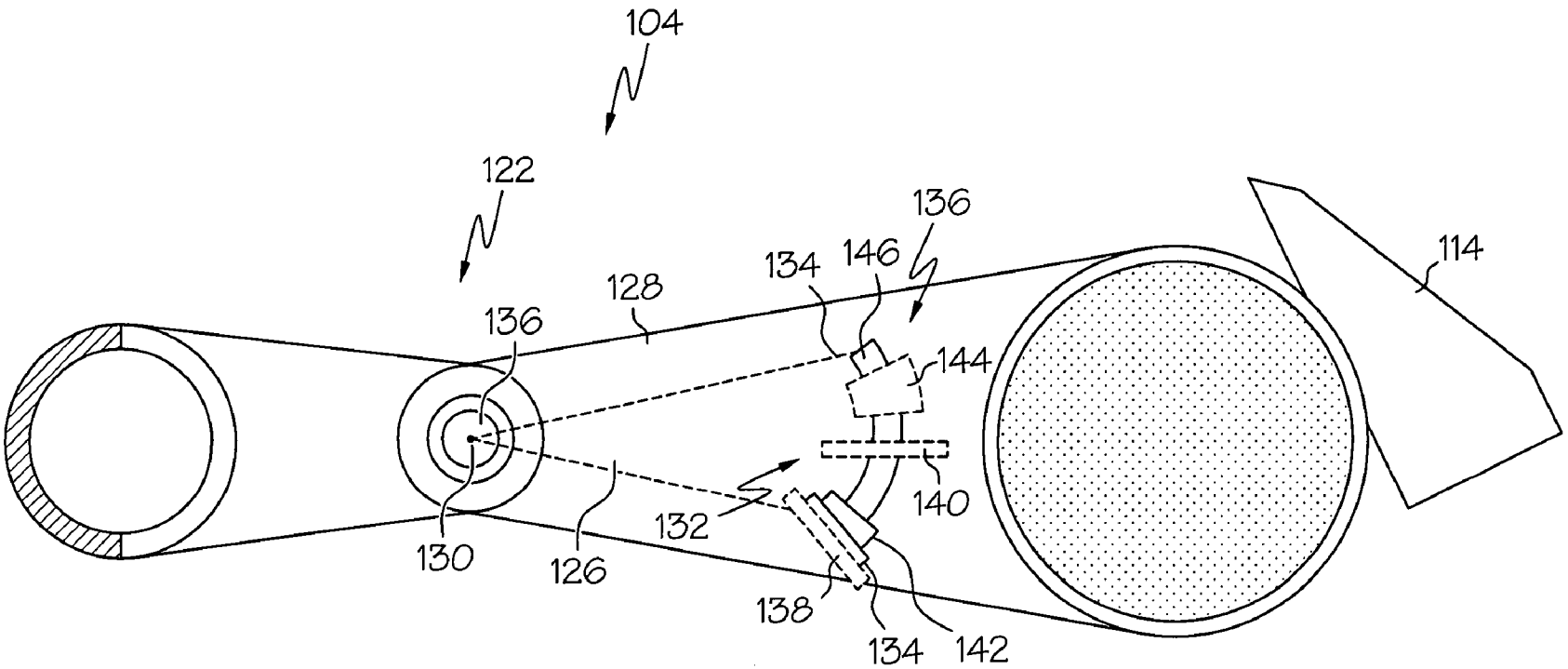
FIG. 4 is a cross section view of the actuator depicted in FIG. 3.

Turning to FIG. 4, the latch assembly 132 includes a first latch mechanism 138 and a second latch mechanism 140. The latch mechanisms 138, 140 are configured to selectively hold the rotating arm in either the first or second positions and are each coupled to the arm assembly 122 at first and second mount positions. The latch assembly 132 may be coupled to either of the arms 126, 128 and either the stationary or rotating arm. It is noted that the first and second mount positions substantially coincide with the first and second positions, respectively, of the rotating arm.

The latch mechanisms 138, 140 may be any one of numerous known devices that are operable to selectively hold the rotating arm in one of the two positions and, in some embodiments, to supply additional rotational energy to the rotating arm to commence, or complete, its rotation, or both. The latch mechanisms 138, 140 preferably employ electromagnetic or magnetic devices, or a combination of both, to hold the rotating arm. Suitable devices that may be employed include, but are not limited to, electromagnets, magnetic coils, pole pieces, or any appropriate combination thereof. The latch mechanisms 138, 140 preferably hold the rotating arm with little or no power consumption.

The stop element 134 is coupled to the arm assembly 122 and positioned at a predetermined point between the first and second latch mechanisms 138, 140. The stop element 134 preferably is coupled to the arm 126, 128 to which the latch assembly 106 is not coupled and is configured to latch to one of the latch mechanisms 138, 140, when the rotating arm is in the first or second positions. The stop element 134 is constructed of any one of numerous types of materials appropriate for magnetically latching to the latch mechanisms 138, 140, such as a permanent magnet.

In some embodiments, a damping coil 142 may be included to damp vibration that may occur when the stop element 134 and latch mechanisms 138, 140 contact one another. The damping coil 142 is coupled proximate the stop element 142 and is preferably a small shorted coil of wire that provides intrinsic damping as the stop element 134 approaches latch mechanisms 138, 140.

The solenoid 136 is configured to facilitate selective rotation of the rotating arm and to provide additional kinetic energy to the fin 114. The solenoid 136 is coupled to the arm assembly 122 and comprises an electromagnetic coil 144 and an electromagnetic core 146. The electromagnetic coil 144 may be coupled to either the first or second arm 128, 130, while the electromagnetic core 146 is coupled to or formed as part of the other arm 128, 130.

The electromagnetic coil 144 is configured to selectively supply a pulse of an appropriate polarity, magnitude, and duration to cause the coil 144 to generate a magnetic field having a desired magnitude and direction within the passage. The electromagnetic coil 144 is constructed of a wire having a passage therethrough and is electrically coupled to a power source (not shown), for example, a low voltage source, The electromagnetic core 146 is capable of attraction to the magnetic field generated by the coil 144 and comprises a suitable magnetically permeable material. Suitable materials include, but are not limited to, iron, nickel, or cobalt. The electromagnetic core 146 is further configured to be capable of moving through the passage of the coil 144. Thus, the electromagnetic core 146 may have any one of numerous shapes suitable for passing through passage, such as a generally elongate shape, a rod, or a bar. Optionally, the electromagnetic core 146 may be configured to serve as a guide for the rotational movement of the rotating arm, and thus, may be arc-shaped.

As briefly mentioned previously, the solenoid 136 cooperates with the latch assembly 132 and stop element 134 to effect the operation of the actuator 116. To this end, any number of solenoids 136 having any one of numerous configurations may be employed. In one exemplary embodiment illustrated in FIG. 4, the electromagnetic coil 144 of the solenoid 136 is mounted to the first arm 126 and is electrically coupled to a power source (not shown) that provides energy pulses thereto. The latch mechanisms 138, 140 are mounted to the first arm 126 and comprise pole pieces that are configured to magnetically latch to the stop element 134. The stop element 134 and electromagnetic core 146 of the solenoid 136 are mounted to the second arm 128 such that the stop element 134 can selectively contact the desired latch mechanism 138, 140. In this embodiment, the first arm 126 is configured to remain stationary relative to rotational movement of the second arm 128, however, as will be appreciated, the first arm 126 may be configured to rotate relative to a stationary second arm 128, or alternatively, both arms 128, 130 may rotate relative to each other.

Figure 5:
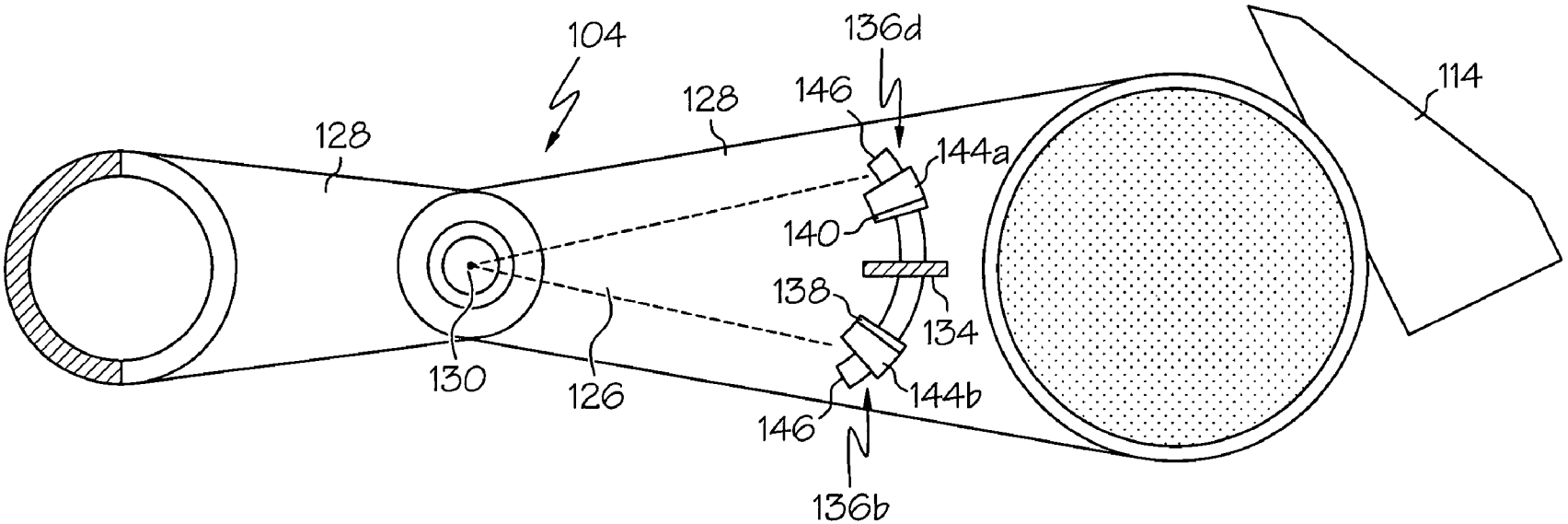
FIG. 5 is a cross section view of another exemplary actuator that may be implemented in the exemplary missile illustrated in FIG. 1.

In another exemplary embodiment shown in FIG. 5, two solenoids 136*a*, 136*b* are employed. The two solenoids 136*a*, 136*b* include first and second electromagnetic coils 144*a*, 144*b* and an electromagnetic core 146. Each electromagnetic coil 144*a*, 144*b* is electrically coupled to a power source (not shown) used to pulse energy thereto. In alternate embodiments, the coils 144*a*, 144*b* may each be coupled to different power sources, or the same power source.

The first and second electromagnetic coils 144*a*, 144*b* are coupled to the first arm 126 and may be positioned along any suitable portion of the first arm 126. The first and second latch mechanisms 138, 140 are also coupled to the first arm 126 and are each positioned outside of and proximate the first and second latch mechanisms 138, 140, respectively. In another embodiment, the electromagnetic coils 144*a*, 144*b* are coupled to the first and second latch mechanisms 138, 140, respectively.

The electromagnetic core 146 is shown as an arc-shaped rail coupled to the second arm 128 so as to be sufficiently close in proximity to the electromagnetic coils 144*a*, 144*b* to be magnetically attracted thereto. The stop element 134 is also coupled to the second arm 128 and is mounted substantially proximate the center of the electromagnetic core 146. The first arm 126 is configured to remain stationary relative to rotational movement of the second arm 128, however, as appreciated by the skilled artisan, the first arm 126 may be configured to rotate relative to a stationary second arm 128, or both arms 126, 128 may be configured to rotate relative to each other.

As will be appreciated by those with skill in the art, the solenoid(s) 136, latch assemblies 138, 140, and stop element 134 may have any one of numerous arrangements along the arm 126, 128 relative to the fin 114 that may be coupled to the actuator 116. The arrangement of the components may depend on a variety of factors, such as space constraints of the fin assemblies 104*a*, 104*b*, cost factors, availability of part for constructing the assembly, or other factors.

No matter the particular embodiment, when the power source is turned on and a pulse having a desired magnitude, polarity and duration is administered to the electromagnetic coil 144, a magnetic field is generated in a first direction. As a result, the electromagnetic core 146 becomes magnetized and attracted towards the first direction of the magnetic field, thereby supplying kinetic energy to the rotating second arm 128 to move in the first direction until the stop element 134 mounted on the second arm 128 contacts and magnetically couples with the first latch mechanism 138 at a first predetermined position, for example, to cause the fin 114 to deploy and move outside of the housing 102. If it is desired that the second arm 128 switch to a second predetermined position, for example, to cause the fin 114 to retract into the housing 102, the power source provides a pulse having a reverse polarity to thereby generate a magnetic field in a second direction and, accordingly, the magnetic attraction of the electromagnetic core 146 changes with the magnetic field to cause the core 146 to move in the second direction. The strength of the magnetic field is such that it overcomes the magnetic attraction of the stop element 134 to the first latch mechanism 138 so that the electromagnetic core 146 travels until the stop element 134 contacts and magnetically couples with the second latch mechanism 140.

Figure 6:
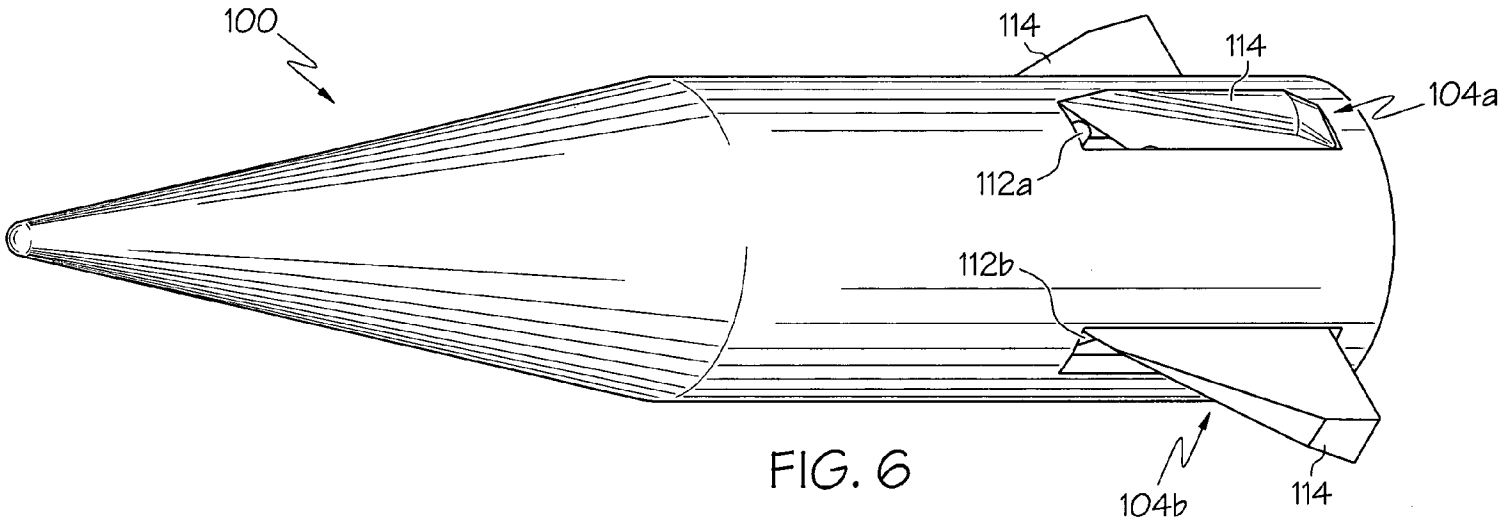
FIG. 6 is an isometric view of the exemplary missile of FIG. 1 fully retracted.
Figure 7:
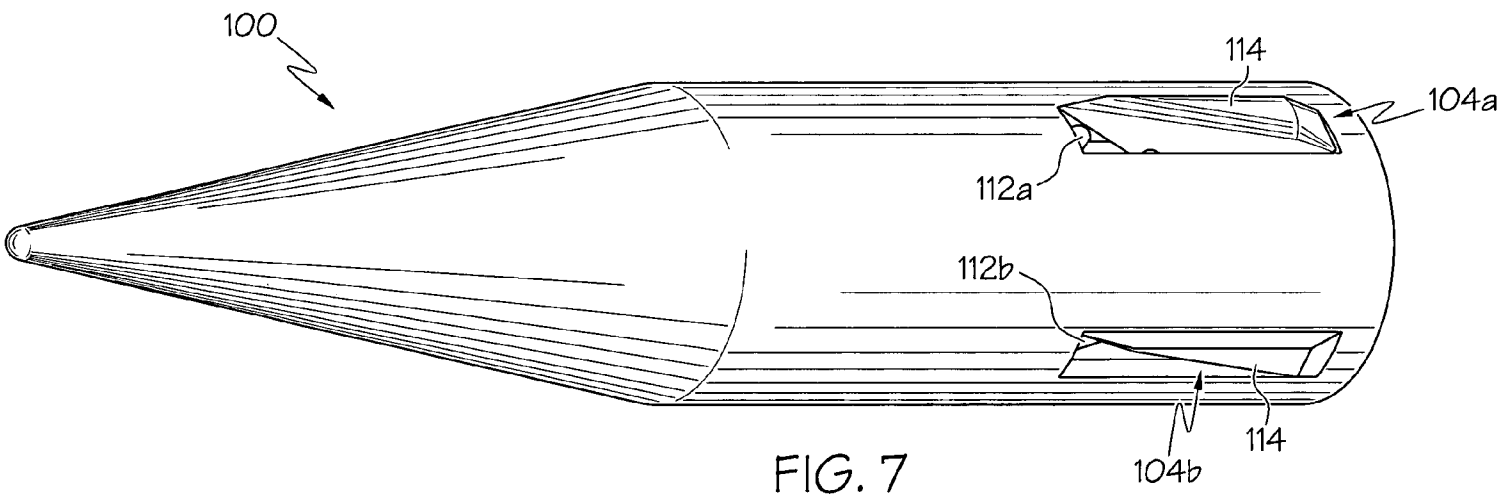
FIG. 7 is an isometric view of the exemplary missile of FIG. 1 partially deployed.

It will be appreciated in that in the case that more than one fin assembly 104*a*, 104*b* and slot 112*a*, 112*b*, are employed, the actuators 116 may be configured to operate together or independently. For example, as shown in FIG. 1, the actuators 116 are used to fully deploy the fins 114. In another example, the actuators 116 fully retract the fins 114, as shown in FIG. 6. In still another example, the actuators 116 operate independently to partially deploy the fins 114, as shown in FIG. 7.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A missile, comprising:

a housing having a slot formed therethrough;

a fin disposed within the housing proximate the slot;

a first actuator coupled to the fin and configured to selectively move the fin at least partially in and out of the housing through the slot a first arm coupled to an axis;

a second arm coupled to the axis and the fin, wherein the second arm is configured to selectively rotate relative to the first arm between a first and second predetermined position; and first and second latch mechanisms mounted to the second arm at first and second mounting positions, respectively, wherein the first mounting position positions the fin out of the housing and the second mounting position positions the fin inside of the housing.

2. The missile of claim 1, wherein the first actuator further comprises:

a stop element coupled to the first arm and positioned between and capable of contacting the first and second latch mechanisms; and an energy supply coupled to the first and second arms and configured to provide kinetic energy to the second arm to thereby cause the stop element to selectively contact the first latch mechanism and the second latch mechanism.

3. The missile of claim 1, wherein the housing has a second slot formed therethrough substantially opposite the housing from the first slot, the projectile further comprising:

a second fin disposed within the housing proximate the second slot; and a second actuator coupled to the second fin and configured to selectively move the second fin at least partially in and out of the housing through the second slot.

4. The missile of claim 1, wherein the housing includes a nose end and a thruster end, the thruster end including an outlet formed therein to allow exhaust gases to escape.

5. The missile of claim 4, wherein the slot is formed proximate the nose end.

6. The missile of claim 4, wherein the slot is formed proximate the thruster end.

7. The missile of claim 1, wherein the housing has a second slot formed therethrough and the actuator is further configured to selectively move the fin at least partially in and out of the housing through the second slot.

8. A missile, comprising:

a tube having a first slot formed therethrough;

a first fin disposed within the tube; and a first actuator coupled to the first fin, the first actuator comprising:

a first arm coupled to an axis;

a second arm coupled to the axis and the fin, wherein the second arm is configured to selectively rotate relative to the first arm between first and second predetermined positions;

first and second latch mechanisms mounted to the second arm at first and second mounting positions, respectively, wherein the first mounting position positions the fin out of the tube and the second mounting position positions the fin inside of the tube;

a stop element coupled to the first arm, the stop element positioned between and capable of contacting the first and second latch mechanisms; and an energy supply coupled to the first and second arms and configured to provide kinetic energy to the one of the first and second arms configured to rotate to thereby cause the stop element to selectively contact the first latch mechanism and the second latch mechanism and to selectively move from inside the tube, through the first slot, at least partially outside of the tube when the first arm rotates relative to the second arm between the first and second predetermined positions.

9. The missile of claim 8, wherein the tube has a second slot formed therethrough substantially opposite the tube from the first slot, the projectile further comprising:

a second fin disposed within the tube; and a second actuator coupled to the second fin, the second actuator configured to selectively move the second fin in and out of the housing through the second slot.

10. The projectile of claim 8, wherein the tube includes a nose coupled thereto at one end and a thruster end at an opposite end of the tube, the thruster end including an outlet formed therein to allow exhaust gases to escape.

11. The projectile of claim 10, wherein the slot is formed proximate the nose end.

12. The projectile of claim 10, wherein the slot is formed proximate the thruster end.

13. The projectile of claim 8, wherein the tube has a second slot formed therethrough and the actuator is further configured to selectively move the fin at least partially in and out of the tube through the second slot.

* * * * *